United States Patent [19]

Birnbach et al.

[11] Patent Number: 4,801,848

[45] Date of Patent: Jan. 31, 1989

[54] TUNABLE BROADBAND SOURCE IN MILLIMETER WAVELENGTH RANGE OF SPECTRUM

[75] Inventors: Curtis A. Birnbach, Bronx, N.Y.; Richard N. Heese, Westmont, Canada

[73] Assignee: Quantum Diagnostics Ltd., Hauppauge, N.Y.

[21] Appl. No.: 48,602

[22] Filed: May 11, 1987

[51] Int. Cl.[4] ..... H01J 25/10

[52] U.S. Cl. ..... 315/5.41; 315/5

[58] Field of Search ..... 315/5.41, 5.42, 5; 313/359.1, 361.1; 328/233

[56] References Cited

U.S. PATENT DOCUMENTS

| | | | |
|---|---|---|---|
| 2,582,186 | 1/1952 | Wilshaw | 315/5.41 |
| 2,633,539 | 3/1953 | Altar | 315/5.41 |
| 3,214,632 | 10/1965 | Harman | 315/5.41 |
| 4,143,299 | 3/1979 | Sprangle | 315/5.41 |

*Primary Examiner*—David K. Moore

*Attorney, Agent, or Firm*—Ostrolenk, Faber, Gerb & Soffen

[57] ABSTRACT

A tunable millimeter wave source in which accelerated electrons are directed into a bending magnet and emit broadband radiation in the millimeter wavelength portion of the spectrum. The electrons are produced by an electron gun using a portion of the microwave energy output from a RF source. The remainder of the microwave energy from the RF source is used to drive an RF linear accelerator which accelerates the electrons and directs them into the bending magnet. An interferometer may be used to select radiation of a particular frequency from the broadband output of the source. In a second embodiment, the source is provided with a plurality of output apertures, and a plurality of respective interferometers are used to select radiation of a number of desired discrete frequencies.

17 Claims, 2 Drawing Sheets

TUNABLE BROADBAND SOURCE IN MILLIMETER WAVELENGTH RANGE OF SPECTRUM

BACKGROUND OF THE INVENTION

1. Field of the Invention:

The present invention relates to a source for producing broadband radiation, and, more specifically, to a tunable source for producing broadband radiation in the millimeter wavelength range of the spectrum.

2. Description of the Prior Art:

Certain analysis or detection schemes operate on the principle that particular objects or substances absorb radiation at particular frequencies or groups of frequencies. For example, a particular type of contraband substance might absorb radiation at discrete frequencies, but not at others. This frequency absorption pattern can be used as a fingerprint to identify the particular substance. Analysis or detection schemes based on this principle must necessarily be able to produce a wide range of selectable frequencies to be applied to the object from a broadband source of radiation. The present invention is directed towards a tunable broadband source having this capability.

In the prior art, gyrotrons have been used to produce broadband radiation in the millimeter wavelength portion of the spectrum. However, gyrotrons are extremely large and bulky, and produce megawatts of power. Such units are entirely impractical for use outside the laboratory, in applications such as airport detection equipment, or even for most medical diagnostic applications.

A backward wave oscillator may also be used to obtain broadband radiation in the desired millimeter range by coupling such a device with frequency multipliers, such as doublers or triplers. The problem with such an arrangement is that the frequency multiplication is very inefficient, and the total output power is less than 1 milliwatt. Backward wave generators are also quite expensive.

A klystron can also be used, in combination with a series of multipliers, to generate a plurality of selected frequency bands in the desired range. However, klystrons, like gyrotrons, are not readily tunable, and thus the number of frequencies which can be selected in the millimeter range is quite limited.

Similarly, certain lasers output a large number of lines in the desired millimeter wavelength range, but these lines, being discrete, do not necessarily correspond to the desired frequencies of interest.

Various solid state emitters such as Gunn diodes and IMPATT emitting diodes also emit radiation in discrete bands, but only at the lower end of the millimeter range. The desired radiation for analysis and detection is generally in the higher millimeter wavelength bands. Again, such devices have limited use in analysis and detection applications because they do not emit broadband radiation.

Simple spark gap devices generate electrical sparks that emit radiation over the entire spectral range. However, the radiation emitted from such devices is very low power and contains excessive interference, thus making the use of spark gaps unmanageable as radiation sources.

SUMMARY OF THE INVENTION

Accordingly, it is the object of the present invention to provide a broadband source in a millimeter wavelength range of the spectrum which is tunable to a plurality of desired wavelengths, lengths, and which may be designed in a compact, lightweight, and inexpensive unit.

The present invention overcomes many of the requirements and disadvantages of the prior art recited above by providing an apparatus and method for producing tunable broadband radiation in the millimeter wavelength range of the spectrum. The invention comprises a microwave energy generator, an electron source, an electron accelerator, and a bending magnet. The microwave energy is fed to the electron accelerator for accelerating the electrons produced by the electron source. The accelerated electrons are directed in a bending magnet which causes the electrons to emit broadband radiation. An interferometer may be provided to receive the broadband radiation and to select a radiation of a desired frequency.

Optionally, a portion of the generated energy may be fed to the electron source for generating the electrons. The RF source for generating the microwave energy may comprise a magnetron, and a RF circulator may be used to prevent the reflection of standing waves produced in the electron accelerator from entering the magnetron. A beam dump may be provided for terminating the travel of the accelerated electrons following their exit from the bending magnet.

In a further embodiment of the invention, the bending magnet is provided with a plurality of apertures for emitting the broadband radiation. A plurality of interferometers each receive the beam of broadband radiation emitted from each of said apertures, and select radiation of a desired individual frequency from each of the beams of broadband radiation.

BRIEF DESCRIPTION OF THE DRAWINGS

Other features and advantages of the invention are described below with reference to the accompanying drawings, in which.

DETAILED DESCRIPTION OF THE PREFERRED EMBODIMENT

Figure 1:
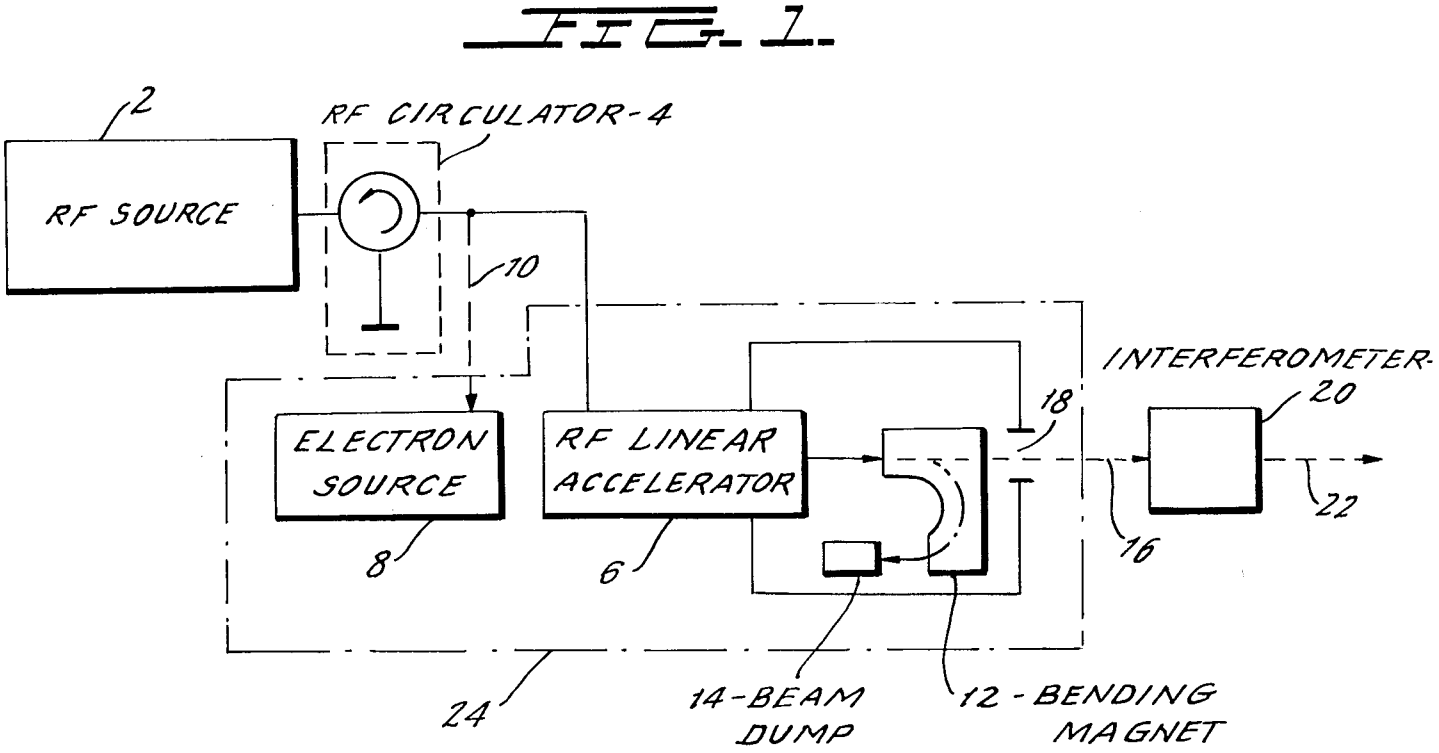
FIG. 1 shows a block diagram of the present invention.

Referring first to FIG. 1, a block diagram of the tunable broadband millimeter source of the present invention is illustrated. As shown at the far left of FIG. 1, a RF source 2 is provided which, in the preferred embodiment, outputs 3 GHz microwave pulses of about 50 megawatts peak power per pulse. The RF source 2 produces about 360 pulses per second, each pulse having a duration of approximately 4–5 usec. In the preferred embodiment, RF source 2 comprises a magnetron, although any suitable equivalent source (e.g. a klystron, a traveling wave tube, or a linac) may be used.

As further shown in FIG. 1, the microwave pulses generated by the RF source 2 may optionally be directed through a RF circulator 4 to prevent the return of any reflected standing waves. The microwave pulses (whether or not sent through RF circulator 4) are directed to a RF linear accelerator 6, where they provide the energy for the acceleration of electrons from an electron source 8, raising the electrons to an energy level of about 40 MeV. Electron source 8 may comprise a conventional electron gun. A portion 10 of the microwave pulses from RF source 2 may optionally be directed to electron source 8 and used to provide the energy for generating electrons.

The accelerated electrons are sent to a bending magnet 12 having a strength of 15 kilogauss. In the preferred embodiment, pulsed magnet operation is used to generate higher fields (i.e., above 20 kilogauss) in a compact, lightweight, and efficient package. The bending magnet 12 bends the electron stream from the RF linear accelerator 6, radiating essentially broadband synchrotron radiation 16 in the millimeter wave range of the spectrum, i.e., from 20 GHz to 3000 GHz (the high end of microwave to far infrared). The accelerated electrons are dumped into beam dump 14.

The broadband radiation 16 generated by bending magnet 12, comprising about 50 to 100 watts of peak power, passes out through an aperture 18 and is directed to an interferometer 20. Interferometer 20 receives radiation 16, and is used to select an individual frequency from the radiation 16 for the desired application.

The electron source 8, RF linear accelerator 6 bending magnet 12 and beam dump 14 are enclosed in a vacuum cleaner 24 having a vacuum of $1\times10^{-6}$ Torr or less. The vacuum can be created by a mechanical or turbo pump that cuts over to an ion pump after the desired vacuum level is achieved.

Figure 2:
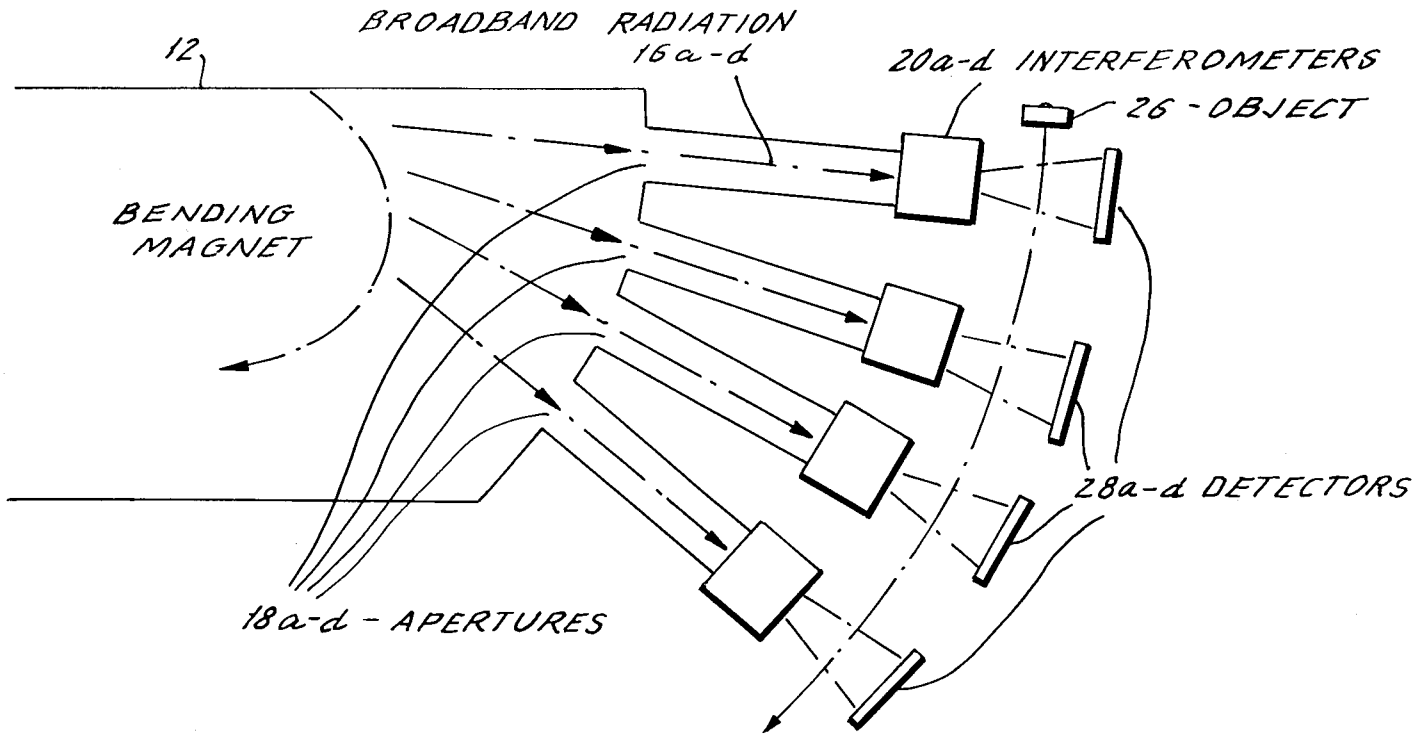
FIG. 2 shows an embodiment of the present invention in which a plurality of broadband radiation beams are produced.

Referring now to FIG. 2, an embodiment of the invention is shown in which a plurality of apertures 18 *a–d* are provided in bending magnet 12. The radiation emitted from bending of electrons in bending magnet 12 passes through the plurality of apertures 18 *a–d* and forms beams of broadband radiation 16 *a–d*. The beams of radiation 30 *a–d* are directed to a plurality of interferometers 32 *a–d*. As discussed above, the interferometers are used to select an individual frequency from each broadband beam 30 *a–d*. This energy can be used, for example, for the analysis of objects 34 by the perturbation of interference fringes, as set forth in U.S. Pat. No. 4,653,855, issued Mar. 31, 1987, entitled "APPARATUS AND PROCESS FOR OBJECT ANALYSIS BY PERTURBATION OF INTERFERENCE FRINGES", assigned to the same assignee as the present application.

To conduct the desired analysis, the object 34 to be analyzed is placed at the output of the interferometer 20, or interferometers 20 *a–d* in FIG. 2, with detectors 28 *a–d* positioned behind the object 26 to be analyzed. The output signals from the various detectors are then combined to form the composite image of the absorption of the object at the particular frequencies selected by the interferometers 20 *a–d*.

Although the present invention has been described in connection with a preferred embodiment thereof, many other variations and modifications will now become apparent to those skilled in the art without departing from the scope of the invention. It is preferred, therefore that the present invention be limited not by the specific disclosure herein, but only by the appended claims.

What is claimed is:

1. An apparatus for producing broadband radiation, comprising:

(a) means for generating microwave energy;

(b) means for generating electrons;

(c) means for accelerating said electrons using said microwave energy;

(d) a bending magnet for bending the path of said accelerated electrons, whereby said accelerated electrons radiate broadband radiation; and (e) frequency selective means for receiving said broadband radiation and for producing radiation of a selected individual frequency from said broadband radiation.

2. An apparatus as recited in claim 1, wherein a portion of said microwave energy is used to generate said electrons.

3. An apparatus as recited in claim 1, wherein said means for generating microwave energy comprises a magnetron.

4. An apparatus as recited in claim 3, wherein said RF source outputs microwave pulses having a power of about 5 megawatts per pulse and a frequency of about 3 gigahertz, at a rate of about 360 pulses per second, each pulse of about 4–5 microsecond duration.

5. An apparatus as recited in claim 1, wherein said means for generating electrons comprises an electron gun.

6. An apparatus as recited in claim 1, wherein said means for accelerating said electrons comprises a RF linear accelerator.

7. An apparatus as recited in claim 1, further comprising means for preventing substantial reflection of any standing waves produced in said accelerating means into said means for generating microwave energy.

8. An apparatus as recited in claim 1, further comprising a beam dump for terminating the travel of said accelerated electrons.

9. An apparatus as recited in claim 1, further comprising means for maintaining siad electron generating means, said accelerating means, said bending magnet and said beam dump under a vacuum.

10. An apparatus for producing broadband radiation, comprising:

(a) means for generating microwave energy;

(b) means for generating electrons;

(c) means for accelerating said electrons using said microwave energy;

(d) a bending magnet for bending the path of said accelerated electrons, whereby said accelerated electrons radiate broadband radiation, said bending magnet having a plurality of apertures for outputting a plurality of beams of said broadband radiation; and (e) a plurality of frequency selective means, each for receiving one of said plurality of beams of broadband radiation and for producing radiation of respective selected individual frequencies from said broadband radiation.

11. An apparatus as recited in claim 10, wherein a portion of said microwave energy is used to generate said electrons.

12. An apparatus as recited in claim 11, wherein said means for generating microwave energy comprises a magnetron.

13. An apparatus as recited in claim 10, wherein said means for generating electrons comprises an electron gun.

14. An apparatus as recited in claim 10, wherein said means for accelerating said electrons comprises a RF linear accelerator.

15. A method for producing broadband radiation, comprising the steps of:

(a) generating microwave energy;

(b) producing electrons;

(c) directing said microwave energy to an electron accelerating means which accelerates said electrons;

(d) directing said accelerated electrons to a bending magnet that bends the path of said accelerated electrons, thereby producing broadband radiation from said accelerated electrons; and (e) selecting radiation of a particular frequency from said broadband radiation.

16. A method as recited in claim 15, further comprising the step of selecting radiation of a plurality particular frequencies from said broadband radiation.

17. A method as recited in claim 15, further comprising the step of using a portion of said microwave energy to produce said electrons.

* * * * *